United States Patent [19]

Wallace et al.

[11] Patent Number: 4,760,940

[45] Date of Patent: Aug. 2, 1988

[54] CARBONATED BEVERAGE DISPENSER HAVING LOW TURBULENCE VALVE

[75] Inventors: Robert P. Wallace, Katonah; William P. Nugent, So. Salem, both of N.Y.; Kenneth C. Newton, Danbury, Conn.

[73] Assignee: Brewster Plastics, Inc., Croton Falls, N.Y.

[21] Appl. No.: 64,536

[22] Filed: Jun. 22, 1987

[51] Int. Cl.[4] ..... B67D 5/56

[52] U.S. Cl. ..... 222/129.1; 222/501; 222/514; 222/547; 222/559; 251/354

[58] Field of Search ..... 222/129.1, 129.3, 129.4, 222/501, 513, 514, 518, 522, 525, 547, 564, 559; 251/344, 354, 353

[56] References Cited

U.S. PATENT DOCUMENTS

| | | | |
|---|---|---|---|
| 986,070 | 3/1911 | Kreibich | 251/353 |
| 2,566,588 | 9/1951 | Thompson | 222/129.1 X |
| 3,717,284 | 2/1973 | Garrard | 222/129.1 X |
| 4,138,092 | 2/1979 | Apellaniz | 251/353 X |

FOREIGN PATENT DOCUMENTS

| | | | |
|---|---|---|---|
| 712451 | 6/1965 | Canada | 222/129.1 |

*Primary Examiner*—Charles A. Marmor

*Attorney, Agent, or Firm*—Mark T. Basseches; Paula T. Basseches

[57] ABSTRACT

A home carbonated beverage dispenser includes a transfer valve for conducting carbonated liquid from a carbonation reservoir to an outlet spout. A characterizing feature of the device and of the valve resides in the provision of complemental arcuate guide surfaces on the relatively movable surfaces of the valve which are brought into registry in the dispensing condition of the valve, whereby fluid flow through the valve is effected with a minimum of turbulence. A restrictor orifice is formed at the port, the orifice being defined by arcuate surfaces which mate with and provide a smooth continuation with elements of the movable valve components, thereby further to minimize turbulence and assure minimal loss of carbonation.

10 Claims, 5 Drawing Sheets

CARBONATED BEVERAGE DISPENSER HAVING LOW TURBULENCE VALVE

BACKGROUND OF THE INVENTION

1. Field of the Invention

The present invention is in the field of carbonated beverage dispensers, and more particularly pertains to a carbonated beverage dispenser for home use.

2. The Prior Art

Commercial apparatus for dispensing carbonated beverages typically comprise cylinders of carbon dioxide which function to carbonate water dispensed. Such devices may include means for metering quantities of flavorants into the carbonated water.

Devices of the type described typically operate at high pressures in the area of 150 to 250 psi. In view of the high concentration and pressure of carbon dioxide available, it is possible to assure a high degree of carbonation of the water, with the attendant pleasant bubbly effect to the consumer.

In a home carbonation system it is manifestly impracticable, for safety and space considerations, to employ the large $CO_2$ tanks commercially employed or the high attendant pressures. In home use the $CO_2$ pressure is reduced to a pressure of approximately 50 psi by pressure regulator mechanisms and the resultant carbonation of water is necessarily not as complete as may be obtained with higher $CO_2$ pressures.

In such home dispensers it is accordingly necessary to minimize any decarbonation of the water so that the bubbly effect is not entirely lost.

SUMMARY OF THE INVENTION

The present invention may be summarized as directed to an improved carbonated beverage dispenser for home use, and more particularly to a low pressure carbonated beverage dispenser wherein the transfer of carbonated water from the reservoir to the dispenser spout is accomplished with an absolute minimum of decarbon ation.

Still more particularly, the present invention is directed to a novel poppet valve mechanism and associated flow restrictor which efficiently transfers carbonated water to a dispenser nozzle with minimal loss of dissolved $CO_2$.

In accordance with the invention a poppet type valve is provided which includes a distributor bore having an arcuate surface, which surface mates with a complementally formed arcuate surface of the valve body when the poppet is shifted to its dispensing condition.

Preferably a flow restrictor forming part of the arcuate curve of the valve body is disposed at the valve port, whereby the flow volume of a stream of carbonated liquid passing through the valve to the dispensing spout is reduced while at the same time it is subjected to a minimum amount of turbulence and, consequently to a minimal amount of gas loss.

It is accordingly an object of the invention to provide a carbonated beverage dispenser for home use characterized in that carbonated liquids are transferred from reservoir to dispenser spout with a minimum of decarbonation.

Still a further object of the invention is the provision of a novel poppet valve assembly for a home carbonated beverage dispenser which is inexpensive to produce and yet is highly efficient in performing the functions of flow restriction and dispensing with minimum $CO_2$ loss.

To attain these objects and such further objects as may appear herein or be hereinafter pointed out, reference is made to the accompanying drawings, forming a part hereof wherein.

Figure 5:
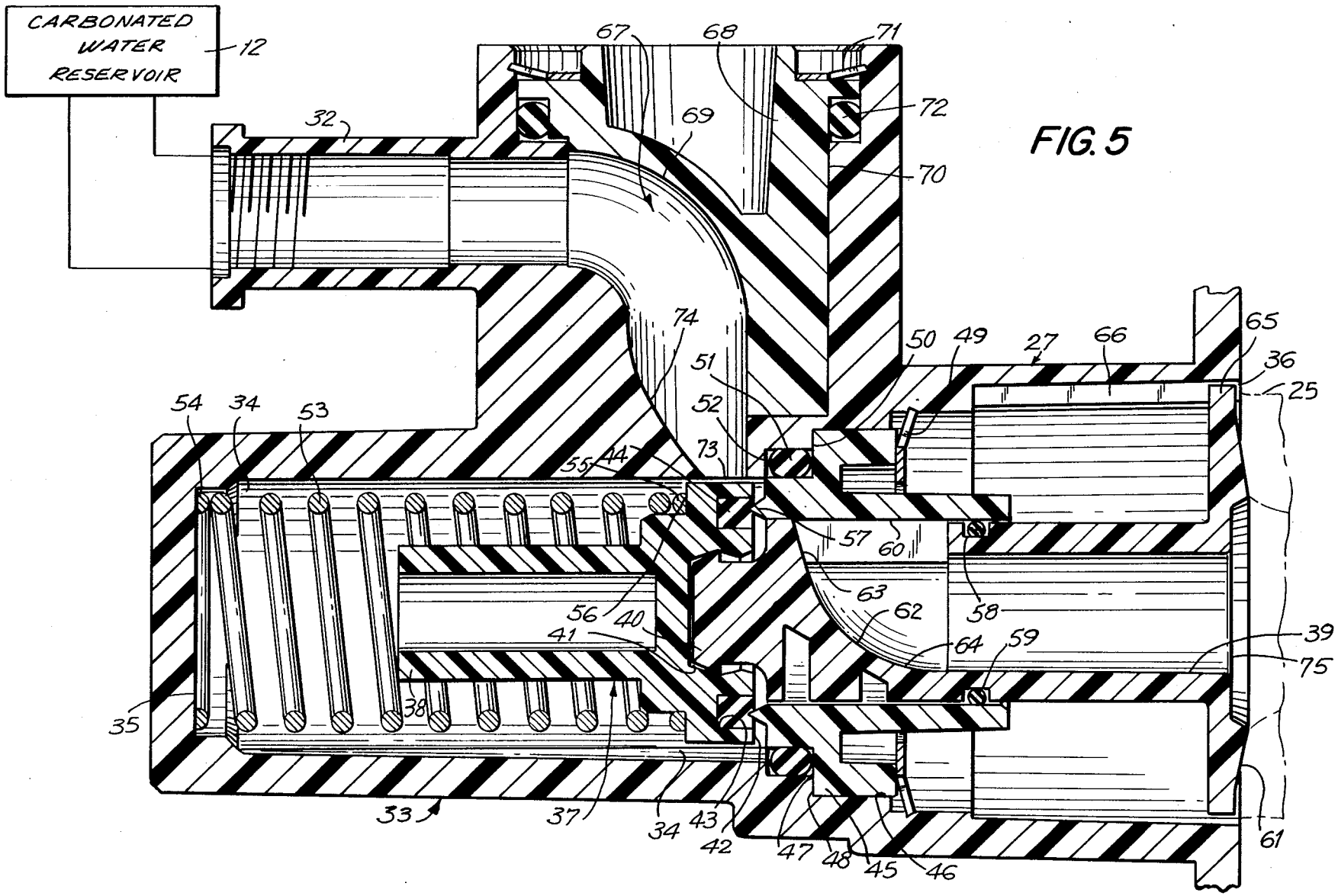
FIG. 5 is a magnified section of the poppet valve assembly taken on the discontinuous line 5—5 of FIG. 2.
Figure 6:
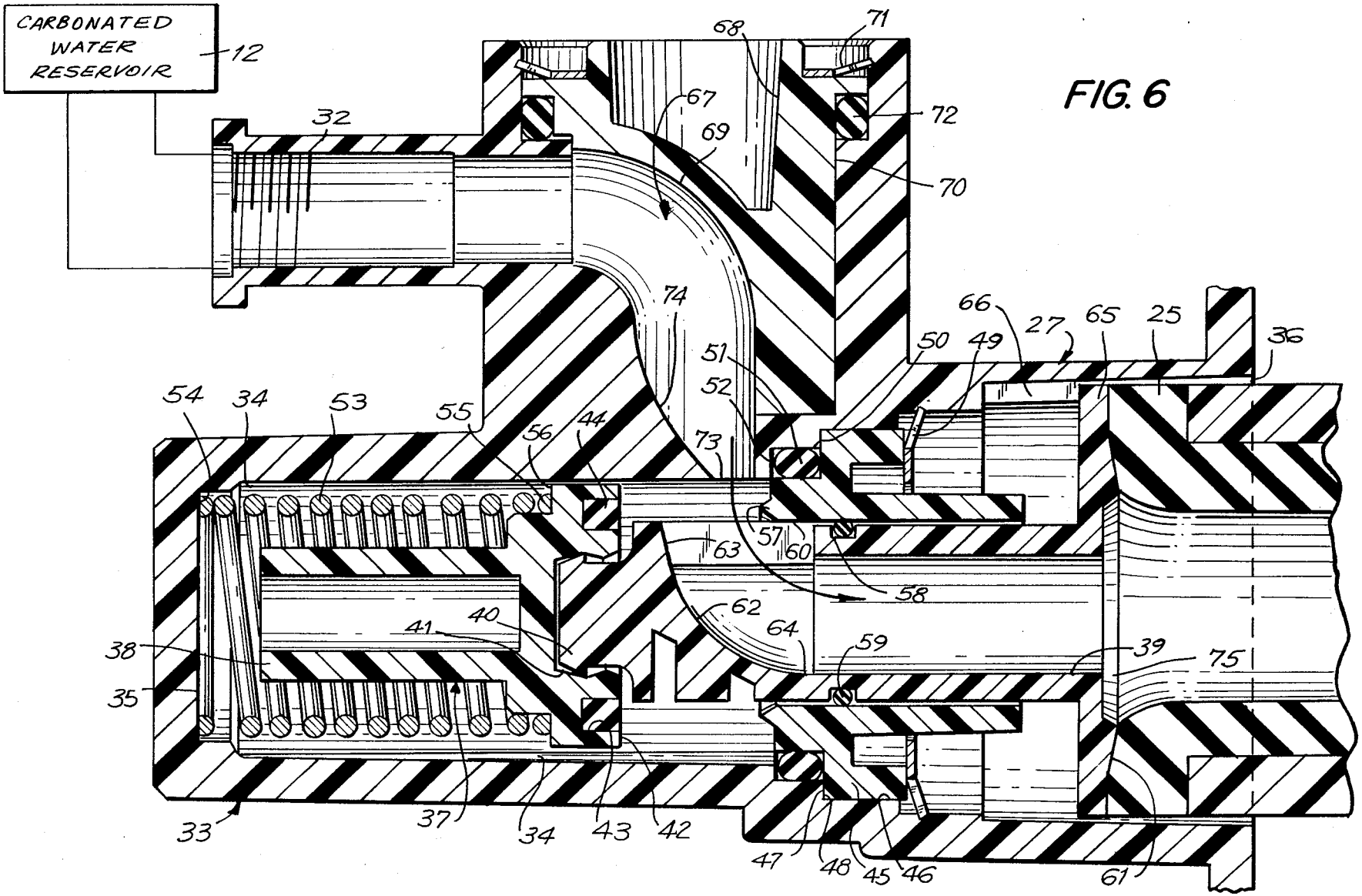
FIG. 6 is a view similar to FIG. 5 showing the position of the parts of the poppet assembly in the dispensing condition thereof.

The principal inventive aspects of the present invention reside in the poppet valve assembly as disclosed in FIGS. 5 and 6 hereof. However, as an aid to an understanding of the operation of the device, the actuator mechanism for the poppet assembly will briefly be described.

Figure 1:
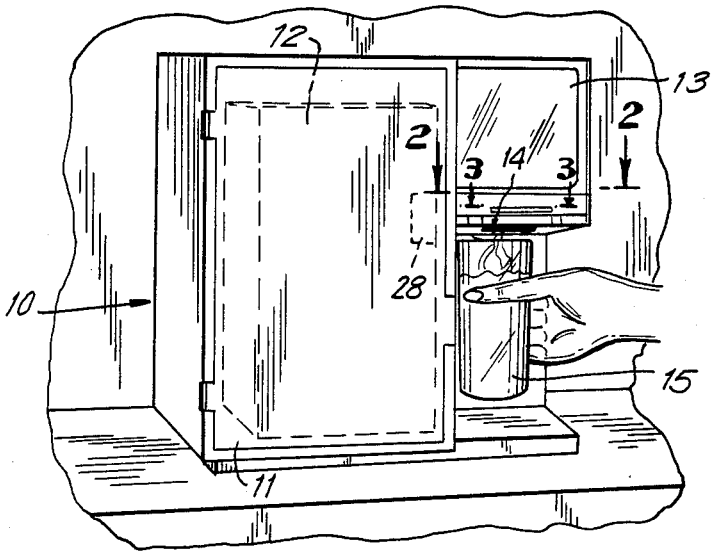
FIG. 1 is a perspective view of a home type carbonated beverage dispenser.

In FIG. 1 there is disclosed a home carbonated beverage dispenser device 10 including a compartment 11 wherein is contained a removable reservoir or flask 12 for storage of carbonated water. The device includes a compartment 13 wherein there is contained a $CO_2$ cartridge and a flavorant container (not shown).

The device includes a lever 14 positioned to be engaged by a glass or like container 15, movement of the glass against the lever functioning to trip actuator valve 16, the change of position of which functions to cause the delivery of carbonated liquid from the reservoir through the dispenser spout 17.

Details of the mechanism of the actuator valve 16 are contained in our copending application entitled HOME DISPENSER FOR CARBONATED BEVERAGES, filed on even date herewith.

In such application there is disclosed a unique valve mechanism which may be tripped by a minimum of pressure exerted by the glass, whereby containers such as wax paper and expanded polystyrene cups may be employed.

As hereinabove noted, there will now be described in general terms a mechanism for shifting the position of the poppet valve of FIGS. 5 and 6, such mechanism being shown in detail in FIGS. 3 and 4.

Figure 3:
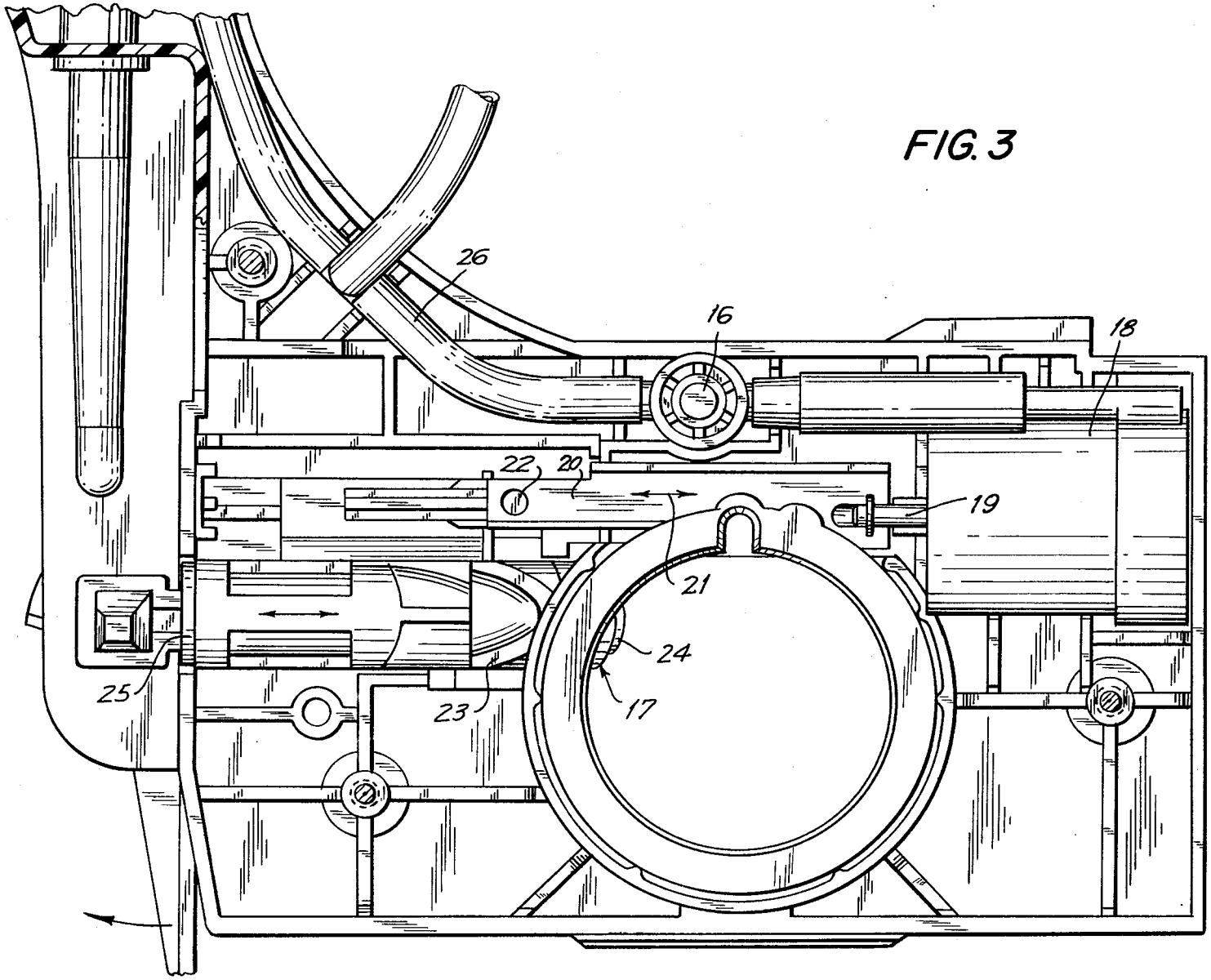
FIG. 3 is a further magnified section taken on the line 3—3 of FIG. 1.

In FIG. 3 the actuator mechanism is disclosed in its inactive or non-dispensing position. The mechanism includes a cylinder 18 within which a piston connected to the piston rod 19 is operably connected. The rod 19 is secured to a slide 20 which is guided for reciprocal movement in the direction of the arrow 21. The rod includes a drive pin 22 which is coupled with or keyed to dispenser spout assembly 17.

The spout assembly includes a rigid cylindrical support member 23 within which is mounted a rubber dispenser tube 24 which extends the length of the support member 23, the tube including an outwardly directed integral rubber flange 25.

Figure 4:
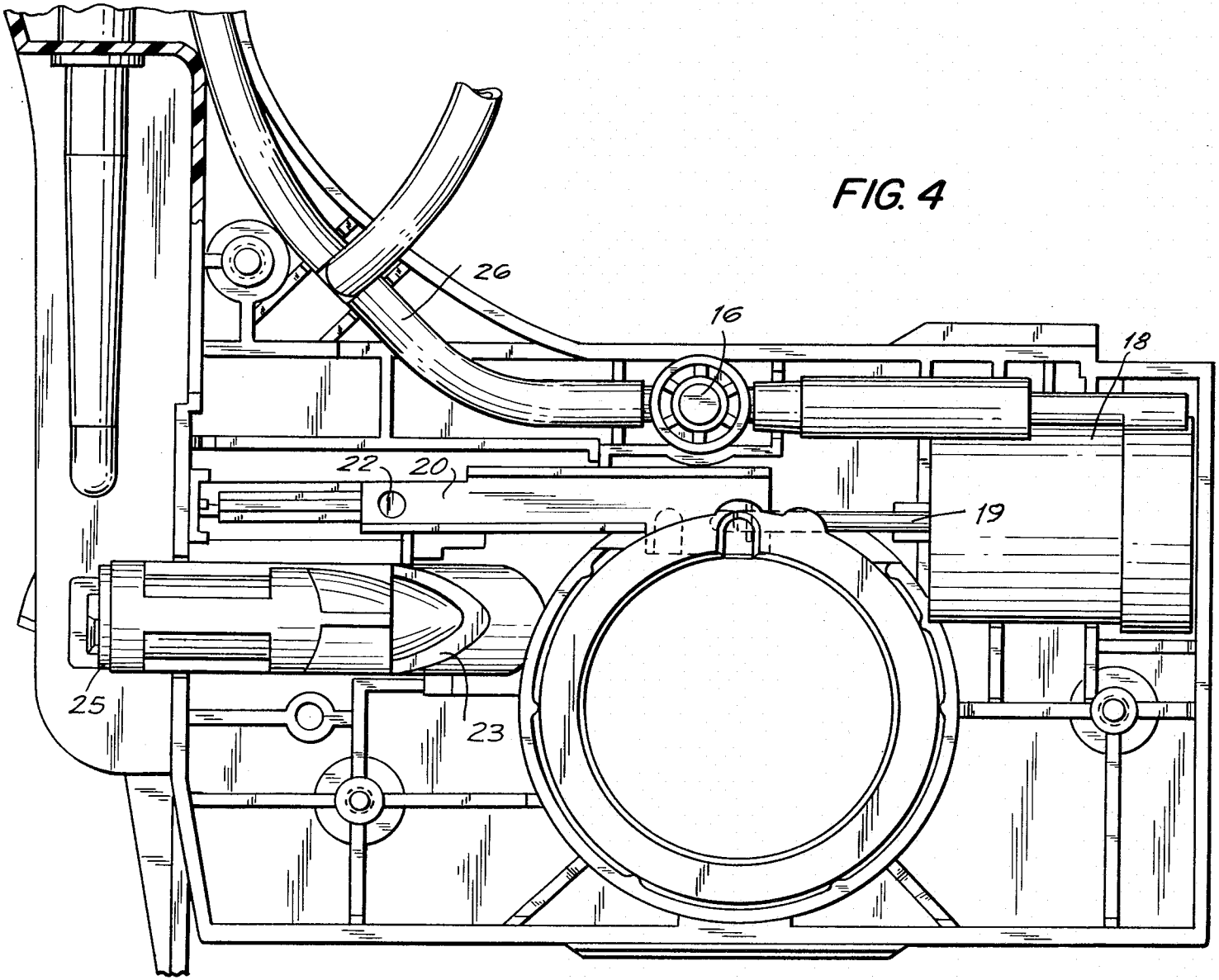
FIG. 4 is a section similar to FIG. 3 showing the position of the parts in the energized or dispensing condition of the device.

From the foregoing general description it will be appreciated that when the valve 16 is actuated by pressure of a glass against paddle or lever 14, the same is tripped, allowing pressure from conduit 26 to shift the position of the piston rod 19 and slide 20 from the position shown in FIG. 3 to the position shown in FIG. 4, whereby the movable spout 17 and its flange 25 are shifted leftward as viewed in FIG. 3 to the position shown in FIG. 4.

As will be more fully understood from the ensuing description, the flange 25 acts against the exterior surface of the poppet valve assembly next to be described, shifting the position of the valve assembly so as to induce flow of a stream of carbonated water from the reservoir 12 through the poppet valve and discharge spout 17.

The poppet valve assembly 27, as shown in FIGS. 5 and 6, is mounted on and forms a part of a connector block 28 (FIG. 2), the block preferably forming a part of the replaceable carbonation reservoir or flask 12.

Figure 2:
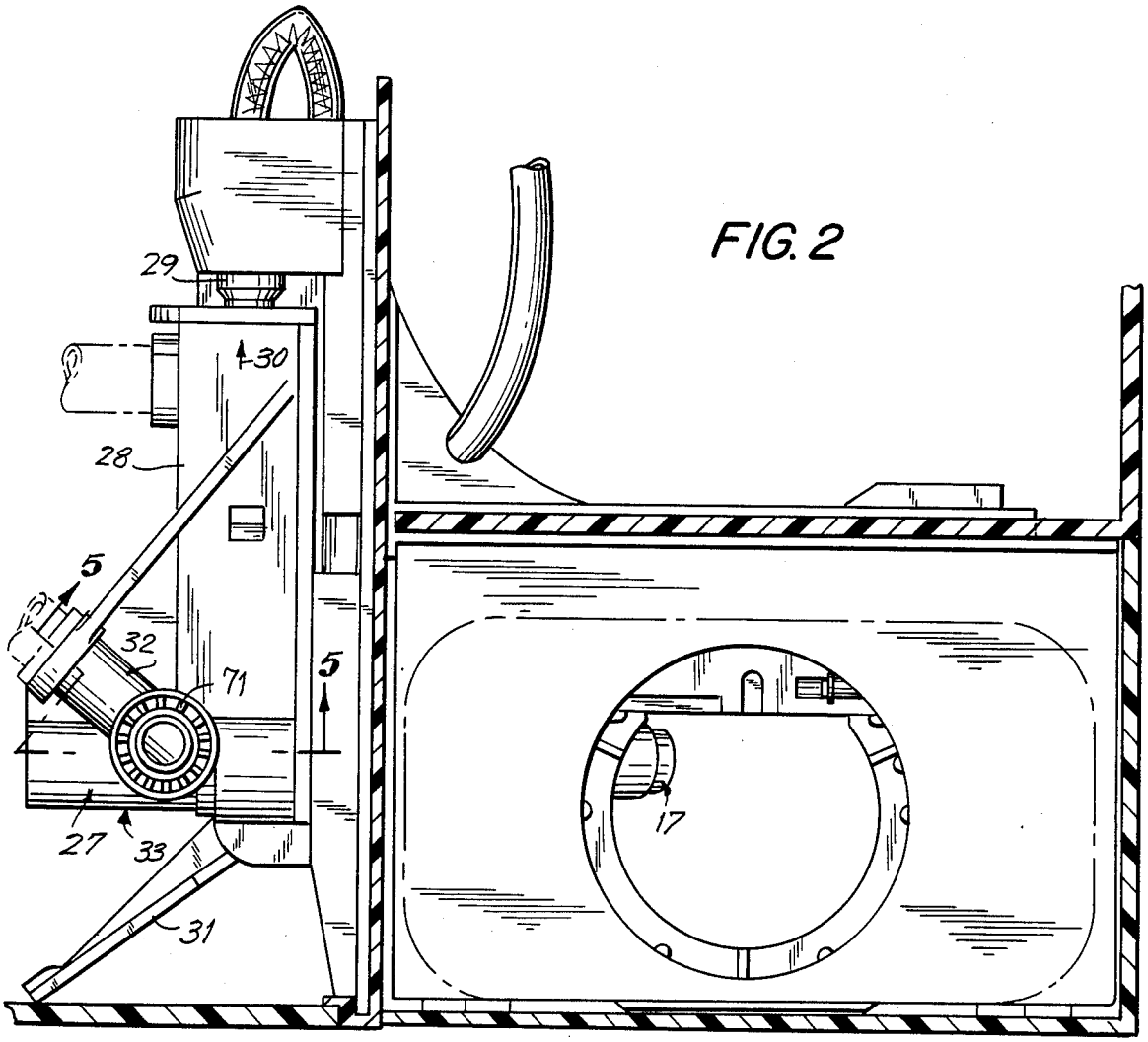
FIG. 2 is a magnified section taken on the line 2—2 of FIG. 1.

The block 28 and its associated reservoir 12 may be coupled to carbon dioxide supply spout 29 by sliding movement of the block in the direction of arrow 30, FIG. 2. A lockig lever 31 may be provided which locks the block to the $CO_2$ supply in a manner not relevant to the present invention.

Turning now to FIG. 5, the poppet assembly 27 is connected to the carbonated water reservoir 12 via conduit 32 forming a part of the valve body 33 of the poppet assembly.

The valve body includes a generally cylindrical bore 34 having a closed end 35 and an open end 36. Movably mounted within the bore 34 is poppet member 37 which is comprised of an inner valve portion 38 and an outer or actuator valve portion 39. Preferably the valve body 33 and the inner and outer valve portions 38 and 39 are comprised of polymeric material such as Nylon, Delrin or the like.

The inner and outer valve portions 38, 39 are snapfittedly connected as by an enlarged head portion 40 of the outer valve portion 39 being received within a complemental cavity 41 formed in the end face 42 of the inner valve portion.

Surrounding cavity 41 there is formed an annular groove 43 facing open end 36 of the valve, the groove having mounted therein an annular gasket 44. An insert member 45 is mounted in an enlarged bore portion 46, the insert member being maintained in position with its lead edge 47 resting against annular shoulder 48 of the valve body by an annular spring retainer washer 49.

Insert 45 includes an annular shoulder 50 which sealingly engages against O-ring 51, compressing the ring against annular shoulder 52 of the valve body to define a seal.

A coil spring member 53 is biased at one end 54 against the closed end 35 of the valve body, the outer end 55 of the spring being biased against annular shoulder 56 of member 38, whereby the gasket 44 is firmly biased against annular sealing lip 57 of the insert 45. Preferably, the lip 57 defines a reduced area ridge or rim whereby an effective high pressure seal is achieved with the gasket 44.

The outer portion 39 of the poppet assembly includes an annular groove 58 within which is mounted O-ring 59, defining a tight seal with the inner bore 60 of the insert 45.

The outer face 61 of the poppet assembly, in the mounted position of the reservoir or flask, is disposed adjacent the rubber flange 25 of the spout insert 24 (FIGS. 5 and 6). An interior surface 62 of the outer valve portion 39 defines a laterally directed arcuate surface which slopes from a generally transverse direction at its outermost edge 63 to a generally axial direction 64 at its innermost terminus.

The member 39 includes a radially projecting key portion 65 which rides in a slot 66 of the valve body so as to prevent the poppet mechanism from rotating within the valve body.

The supply conduit 32 is provided with a continuation portion 67 defined in part by the valve body 27 and in part by an insert 68. Insert 68 includes an arcuate wall portion 69 defining a guide surface for fluid passing through conduit 32. The insert is maintained in a receiver channel 70 by spring clamp 71, an O-ring 72 sealing the channel 70 by being compressed between complemental components of the valve body and insert.

The conduit 32 terminates at an inlet portion 73, mating with bore 34 of the valve body. The port 73 defines a restrictive or reduced cross section area which functions as a flow volume limiter for carbonated fluids passing from the poppet assembly.

Adjacent the port 73 passage 67 is formed with an arcuate guide surface 74.

The operation of the device will next be described.

Upon actuation of the valve 16 piston rod 19 and slide 20 will extend leftwardly as depicted in FIG. 3 to the condition or position of FIG. 4. Concomittantly, the spout member 17, including spout body portion 23 and rubber insert 24, will be carried leftwardly to the position of FIG. 4 and as shown in FIG. 6.

As will be observed, such leftward movement will function to shift the poppet components 38 and 39 to the left, lifting the gasket 44 from sealing engagement with annular lip 57 and simultaneously aligning the arcuate surface 62 of the outer member 39 with the arcuate surface 74 adjacent port 73 (FIG. 6).

When thus oriented it will be perceived that the arcuate surfaces 74 and 62 define a continuous, smooth flow path free from abrupt turns or discontinuities.

In such position carbonated fluid admitted at conduit 32 flows outwardly through discharge aperture 75 of the outer valve member 39, through the rubber spout insert 24 and into the glass of the user.

The provision of the described respective contiguous guide surface of the valve body and poppet assembly minimize turbulence in the transfer area from the body to the poppet, whereby loss of carbon dioxide is kept to a minimum.

A restrictor member is necessarily provided somewhere in the conduit 32 in order to limit the speed of flow of carbonated fluids to the glass. In prior art devices such restrictor mechanism was employed at a position upstream of the valving components. By providing a restrictor at the actual port wherein transfer of the fluid from the valve body to the poppet member is effected, the loss of carbonation is greatly minimized.

From the foregoing it will be evident that there is described a poppet or transfer valve wherein the fluid conducting components at the transfer interfaces define streamlined interconnecting scoops or arcuate surfaces whereby disruption of the path of carbonated fluid is minimized, with consequent minimization of loss of carbonation. This feature is especially important in a home carbonating arrangement wherein low pressure carbonation is necessarily used.

As will be evident to those skilled in the art and familiarized with the instant disclosure, numerous changes may be made in details of construction without departing from the spirit of the invention, which is accordingly to be broadly construed within the scope of the appended claims.

Having thus described the invention and illustrated its use, what is claimed as new and desired to be protected Letters Patent is:

1. In a carbonated beverage dispenser for home use of the type which includes a carbonated water reservoir and a discharge spout, a low turbulence flow restrictor and dispenser poppet valve mechanism for conducting carbonated water from said reservoir to said spout comprising a valve body including a cylindrical bore having an open and a closed end, a poppet member axially movably mounted in said bore, annular seal means mounted in said bore, spring means interposed between said closed end and said poppet member for yieldingly urging said poppet member against seal means, thereby to separate said bore into a first chamber between said closed end and said seal means, and a second chamber between said seal means and said open end, said poppet member being shiftable axially in said bore toward said closed end from said sealing position to a retracted dispensing position clear of said seal means, a poppet actuator member contacting said poppet member slidably mounted in said second chamber of said bore for movement toward and away from said closed end, said actuator member including an axial passageway extending inwardly from said open end, said passageway including a laterally directed scoop portion having an arcuate guide surface, a port formed in said valve body and entering into said first chamber, said port having a reduced diameter restrictor passage outwardly of and adjacent said bore, said passage including an arcuate guide surface directed toward the axis of said bore and curving toward said open end, said guide surfaces of said poppet actuator and said restrictor passage being disposed in registry in said dispensing position of said poppet, said surfaces together defining an essentially continuous carbonated water guide surface directed toward said open end.

2. A dispenser in accordance with claim 1 wherein said poppet member includes a face portion directed toward said open end and said seal means comprises an annular gasket member mounted on said face portion, and an annular shoulder formed in said bore and directed toward said closed end, said shoulder being seated on said gasket member in said sealing position of said poppet member.

3. A dispenser in accordance with claim 2 wherein said annular shoulder terminates in a sharpened annular lip engaging said gasket member in said sealing position.

4. A dispenser in accordance with claim 1 wherein said poppet member and said actuator member are comprised of polymeric material, said poppet and actuator members being snap-fittedly connected to each other.

5. In a carbonated beverage dispenser for home use of the type which includes a carbonated water reservoir and a discharge spout, a low turbulence restrictor and dispenser poppet valve mechanism for conducting carbonated water from said reservoir to said spout comprising a valve body of polymeric material, said body having a cylindrical bore including an open and a closed end, a poppet member axially movably mounted in said bore, annular seal means mounted in said bore, spring means interposed between said closed end and said poppet member for yieldingly urging said poppet member against said seal means, thereby to separate said bore into a first chamber between said seal means and said closed end, and a second chamber between said seal means and said open end, said poppet member being shiftable axially in said bore toward said closed end from said sealing position to a retracted dispensing position, a poppet actuator member slidably mounted in said second chamber of said bore and contacting said poppet member for movement toward and away from said closed end, said actuator member including an axial passageway extending inwardly from said open end, said passageway including a laterally directed scoop portion having an arcuate guide surface, a port formed in said valve body and entering into said first chamber, said port having a passage outwardly of and adjacent said bore an arcuate guide surface formed in said passage and merging with said port, said guide surface of said passage including an upstream portion directed generally toward the axis of said bore and a downstream portion curving generally toward said open end of said bore, said guide surfaces of said poppet actuator and said passage being disposed in registry in said dispensing position of said poppet, said surfaces together defining an essentially continuous arcuate carbonated water guide surface directed toward said open end.

6. A device in accordance with claim 5 and including a reduced diameter flow restrictor in said passage.

7. A dispenser in accordance with claim 6 wherein said flow restrictor is disposed at said port and said arcuate surfaces of said passage comprise portions of said restrictor.

8. A dispenser in accordance with claim 5 wherein said poppet member includes a face portion directed toward said open end and said seal means comprises an annular gasket member mounted on said face portion, and an annular shoulder formed in said bore and directed toward said closed end, said shoulder being seated on said gasket member in said sealing position of said poppet member.

9. A dispenser in accordance with claim 8 wherein said annular shoulder terminates in a sharpened annular lip engaging said gasket member in said sealing position.

10. A dispenser in accordance with claim 5 wherein said poppet member and said actuator member are comprised of polymeric material, said poppet and actuator members being snap-fittedly connected to each other.

* * * * *